United States Patent [19]

Dimarco et al.

[11] 4,300,030

[45] Nov. 10, 1981

[54] HANDLE BLOCKING MEANS FOR CIRCUIT BREAKER

[75] Inventors: Bernard Dimarco, Bellefontaine; Andrew J. Kralik, Marysville, both of Ohio

[73] Assignee: Gould Inc., Rolling Meadows, Ill.

[21] Appl. No.: 104,622

[22] Filed: Dec. 17, 1979

[51] Int. Cl.[3] ..... H01H 9/28

[52] U.S. Cl. ..... 200/42 T

[58] Field of Search ..... 200/42 T, 42 R, 334, 200/44, 321, 322, 327

[56] References Cited

U.S. PATENT DOCUMENTS

| | | | |
|---|---|---|---|
| 2,832,857 | 4/1958 | Landmeier | 200/42 T |
| 2,937,248 | 5/1960 | Michetti | 200/42 T |
| 3,055,995 | 9/1962 | Snow | 200/44 |
| 3,327,075 | 6/1967 | Phillipson | 200/42 T |
| 3,376,400 | 4/1968 | Batt et al. | 200/42 T |

*Primary Examiner*—John W. Shepperd

*Attorney, Agent, or Firm*—Bernard Gerb; Jerome M. Berliner; Harold Huberfeld

[57] ABSTRACT

A blocking attachment to limit movement of a circuit breaker operating handle consists of a single member constructed of material having the resilient properties of sheet steel. Outwardly extending tabs at opposite ends of the attachment are inwardly movable for mounting and dismounting the attachment with respect to a circuit breaker housing. An inverter L-shaped section of the attachment defines a freeway wherein the circuit breaker handle is movable from On to Trip positions and is readily viewable to determine when automatic tripping has taken place. Handle movement is limited to the freeway so that the circuit breaker may not be opened manually while the blocking attachment is operatively mounted to the circuit breaker.

17 Claims, 10 Drawing Figures

HANDLE BLOCKING MEANS FOR CIRCUIT BREAKER

This invention relates generally to handle blocking attachments for circuit breaker switches and more particularly relates to a handle blocking attachment which is completely dismounted from the circuit breaker when not in use.

Under normal conditions, many situations arise where, the operating setting of a circuit breaker, either On or Off, should not be interfered with. That is, if a circuit breaker is Off so that the load protected thereby may be serviced or inspected the circuit breaker should not be closed without the knowledge of the serviceman. On the other hand, a circuit breaker protecting a clock circuit should not be opened except under very special circumstances. To prevent accidental operation of a circuit breaker handle and to prevent intended operation by unknowledgeable persons, the instant invention provides a blocking attachment that may readily be installed and removed by knowledgeable personnel.

U.S. Pat. No. 2,937,248 issued May 17, 1960 to A. Michetti for a Circuit Breaker Handle Lock illustrates a blocking attachment that is mounted to a circuit breaker handle and is selectively positionable to prevent accidental movement of the circuit breaker handle from its On or Off position, as the case may be. While the handle blocking attachment of the aforesaid U.S. Pat. No. 2,937,248 blocks operation of the circuit breaker handle, the attachment prevents the circuit breaker handle from assuming a Trip position intermediate the On and Off positions thereof, so that it is impossible to ascertain whether the circuit breaker has tripped automatically. Further, since the blocking attachment is mounted to the circuit breaker handle there is a tendency to move the attachment to its operative blocking position even though conditions do not dictate that operation of the circuit breaker handle be blocked.

In order to overcome the foregoing conditions present when utilizing prior art handle blocking devices, the instant invention provides a circuit breaker handle blocking attachment which permits the circuit breaker handle to move to an intermediate Trip position. Further, when not in use the blocking attachment is completely dismounted from the circuit breaker, and mounting of the attachment while simple for a knowledgeable person, will probably present problems for an unknowledgeable person.

Briefly, the handle blocking attachment of the instant invention is a single element constructed of resilient material formed with oppositely facing tabs at the respective ends thereof. To mount and dismount the attachment, these tabs are forced inward so that they will clear the ends of the boundary for a circuit breaker aperture through which the operating handle extends. When the attachment is released, the tabs thereof spring outward to their holding positions. The attachment includes a main section defining a freeway wherein the circuit breaker handle is movable, say from one extreme, closed, or On position to an intermediate or Tripped-open position. A blocking section of the attachment interferes with movement of the circuit breaker handle from the intermediate to the other extreme, open, or Off position thereof.

Accordingly, a primary object of the instant invention is to provide a novel improved circuit breaker handle blocking attachment comprising a single element which is completely detached from the circuit breaker when not in use.

Another object is to provide a blocking attachment of this type which permits movement of the circuit breaker handle to Trip position.

Still another object is to provide a blocking attachment of this type constructed to permit visual observation of the circuit breaker handle from the front of the circuit breaker.

A further object is to provide a handle blocking attachment of this type which permits visual observation of indicia indicating handle position.

A still further object is to provide a handle blocking attachment of this type constructed in a manner such that mounting and/or dismounting thereof is facilitated by utilizing a simple tool, such as a screwdriver.

These objects as well as other objects of this invention shall become readily apparent after reading the following description of the accompanying drawings in which.

Figure 2:
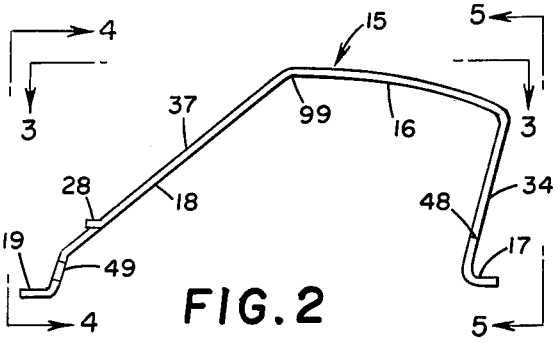
FIG. 2 is a side elevation of the blocking attachment of FIG. 1 shown in dismounted or inoperative position.
Figure 4:
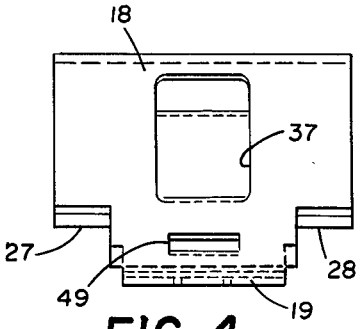
Figure 5:
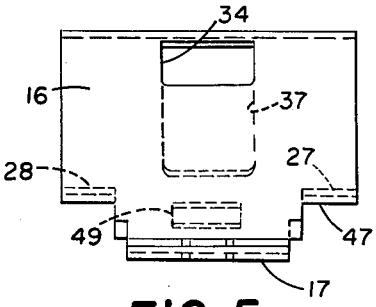
Figure 3:
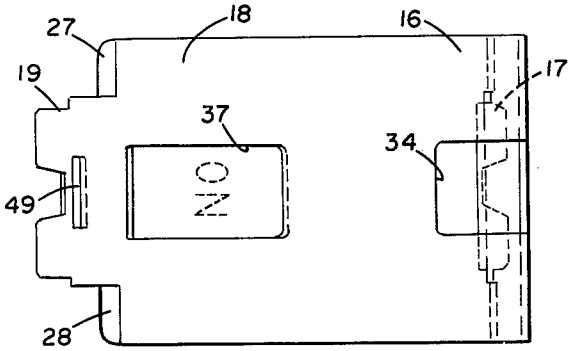
FIG. 3 is a front elevation of the blocking attachment looking in the direction of arrows 3—3 of FIG. 2.

FIGS. 4 and 5 are end views of the blocking attachment looking in the directions of the respective arrows 4—4 and 5—5 of FIG. 2.

Figure 6:
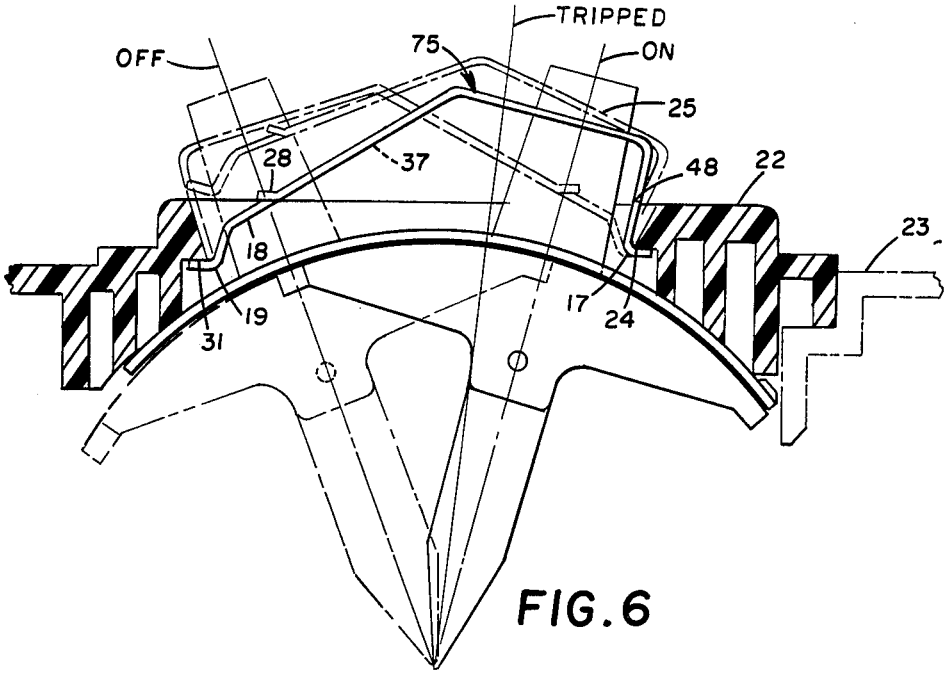

FIG. 6 is a side elevation of a second embodiment of the instant invention shown mounted to a circuit breaker.

Figure 7:
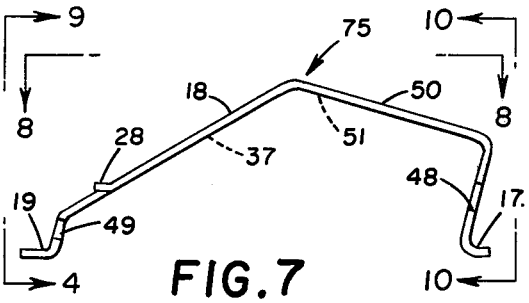

FIG. 7 is a side elevation of the blocking attachment of FIG. 6 shown in its dismounted or inoperative position.

Figure 8:
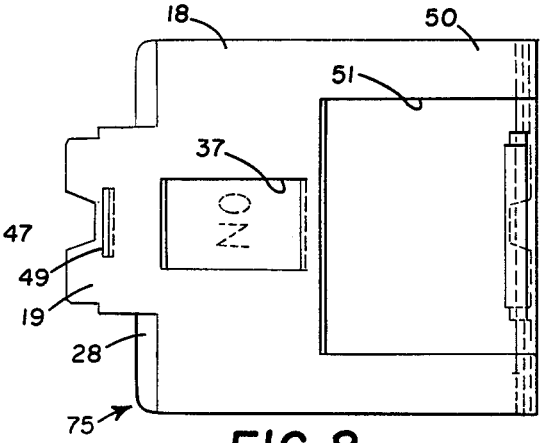

FIG. 8 is a front elevation of the blocking attachment of FIG. 7 looking in the direction of arrows 8—8.

Figure 9:
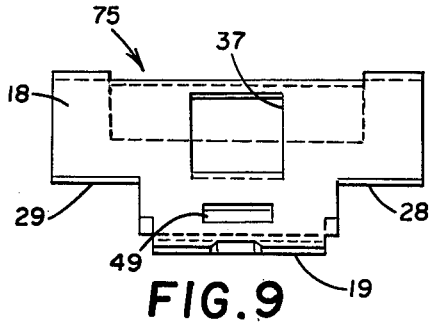
Figure 10:
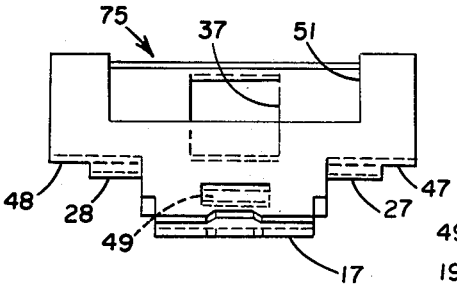

FIGS. 9 and 10 are end views of the blocking attachment of FIG. 7 looking in the directions of the respective arrows 9—9 and 10—10.

Figure 1:
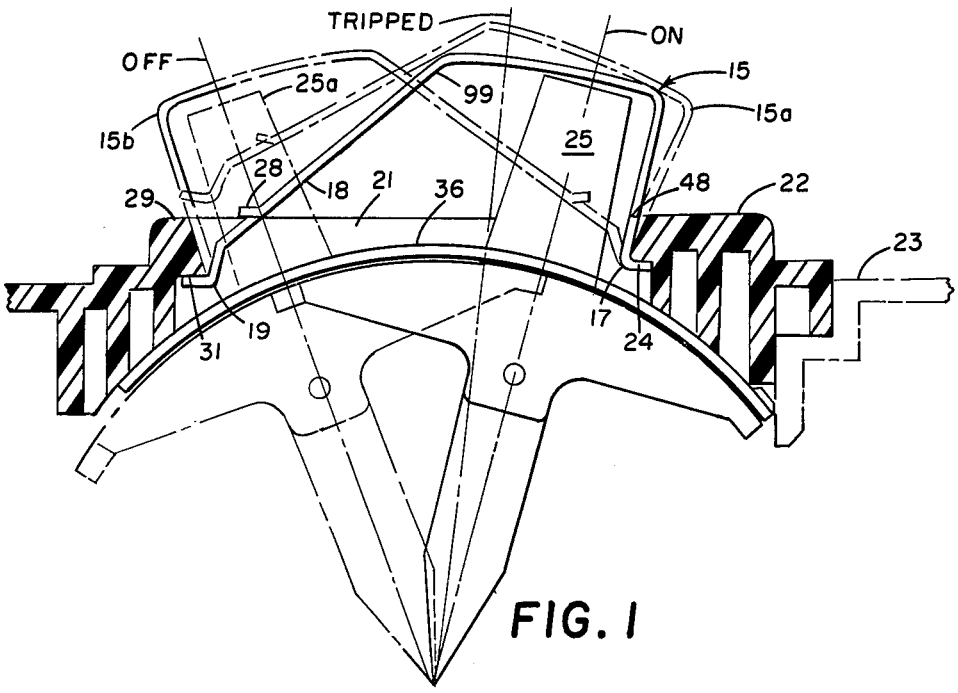
FIG. 1 is a side elevation of a handle blocking attachment constructed in accordance with the instant invention shown mounted to a circuit breaker.

Now referring to the drawings and more particularly to FIGS. 1 through 5. Handle blocking attachment 15 is a single element formed of relatively stiff resilient material, typically sheet steel. Attachment 15 includes inverted L-shaped main section 16 having holding tab 17 at one end thereof and blocking section 18 at the other end thereof. Another holding tab 19 is disposed at the end of section 18 remote from section 16. Thus, tabs 17, 19 are at opposite ends of attachment 15 and extend away from one another. Attachment 15 is mounted by inserting tab 17 rearward through handle aperture 21 in the front cover 22 of circuit breaker housing 23 until tab 17 engages seating formation 24 on the inner surface of front cover 22 as illustrated in FIG. 1. Now attachment 15 is in the phantom position **15*a* of FIG. 1. Thereafter tab 19 is forced inward (to the right with respect to FIG. 1) toward tab 17 and attachment 15 is pivoted counterclockwise until formations 27, 28 engage the upper surface 29 of cover 22. Then tab 19 is permitted to spring outward and move behind seating formation 31. Now attachment 15 is in the solid line position of FIG. 1**.

Formations 27, 28 extend sideways and outboard of tab 19, and function as lateral stabilizers for attachment 15. The latter is also stabilized laterally through the engagement of main section edge sections 47, 48 with outer cover surface 29.

Circuit breaker, contact operating handle 25 extends forward through cover aperture 21 and, in the absence of blocking attachment 15, handle 25 is movable between the ends of cover aperture 21 between the solid line On or closed switch position and the phantom position 25*a* wherein the circuit breaker is Off or open. However, with attachment 15 mounted on its operative position of FIG. 1, the right end 99 of blocking formation 18 engages handle 25 to prevent further counterclockwise movement thereof. When handle 25 engages blocking section 18, the former is in an intermediate position corresponding generally to the position handle 25 will occupy when the circuit breaker trips automatically as a result of fault current conditions. Thus, it is seen that when the circuit breaker opens automatically, or trips, handle 25 will move to the Trip position. The fact that handle 25 is no longer in the On position, may be viewed from in front of the circuit breaker through window 34 in main section 16. When handle 25 is in its On position it may be viewed directly through window 34 and additionally On indicia carried by handle apron 36 may be viewed from in front of attachment 15 through window 37 in blocking section 18.

To facilitate moving holding tab 19 toward holding tab 17, for either mounting or dismounting of attachment 15, a tool receiving formation in the form of elongated slot 49 is provided in blocking section 18 in the vicinity of tab 19. Slot 49 is intended to receive the working end of a screwdriver through which force is applied toward the right with respect to FIG. 1.

Handle 25 may be prevented from moving to the On position from the Off position by reverse mounting of blocking attachment 15 so that the latter is in the phantom position indicated by reference numeral 15*b*.

The attachment 75 of FIGS. 6 through 10, differs from the embodiment of FIGS. 1 through 5 in that inverted L-shaped main section 50 of the latter not only provides a freeway, as defined by main section 16, for movement of circuit breaker handle 25, but also provides a window 51 in which handle 25 moves from one of its extreme positions toward an intermediate position so that handle 25 is directly viewable from both the front and side of the circuit breaker. Since the other portions of attachment 75 are essentially the same as those of attachment 15, like reference numerals have been used to designate like portions of attachments 15 and 75, and for the sake of brevity no additional description of attachment 75 is given herein.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A handle blocking attachment for detachable mounting to and use with a switch including a front cover having an aperture equipped with first and second seating formations at opposite first and second ends of said aperture and a contact operating handle extending externally of the cover through said aperture and reciprocable parallel to the sides of said aperture between the ends of said aperture to open and closed contact positions as well as to a tripped-open position intermediate the open and closed contact positions, said attachment comprising:

oppositely facing first and second holding tabs extending outward from the respective first and second ends of said attachment for engagement with seating formations in said front cover at opposite ends of said aperture;

a main section forward of said first tab defining a freeway through which a handle is movable from a first position at said first end to an intermediate position located a substantial distance toward said second end;

a blocking section between said main section and said second tab to limit movement of a switch handle beyond said intermediate position toward said second end; and a tool receiving formation disposed in the vicinity of one of said tabs to receive a tool through which a force is applied to said attachment in a direction resulting in a relatively inward movement of said tabs.

2. A handle blocking attachment as set forth in claim 1 in which said main section is provided with a window through which a circuit breaker handle in its first position is viewable from in front of said attachment.

3. A handle blocking attachment as set forth in claim 1 in which the blocking section is provided with a window through which handle position indicia carried by the handle is viewable from in front of said attachment.

4. A handle blocking attachment as set forth in claim 1 in which the tool receiving formation is in said blocking section in the vicinity of the second tab.

5. A handle blocking attachment as set forth in claim 1 in which the attachment comprises a single element.

6. A handle blocking attachment as set forth in claim 1 in which the attachment comprises a single element constructed of formed sheet steel.

7. A handle blocking attachment as set forth in claim 1 also including formations extending sideways and outboard of said tabs in the vicinity of said tabs and positioned forward thereof to engage the outer surface of a switch housing and thereby provide lateral stabilization for said attachment.

8. A handle blocking attachment for detachable mounting to and use with a switch including a front cover having an outer and inner suface having an aperture therethrough, said cover equipped with first and second seating formations at opposite ends of said aperture disposed on said inner surface of said cover, said switch further including a contact operating handle extending from said inner to said outer surface externally through said housing, said handle reciprocally positionable from one to the other of said ends, from open to closed contact positions, as well as to a tripped-open position intermediate the open and closed contact positions, said attachment comprising:

a main section defining a freeway for allowing said handle to move between one of said end positions and said intermediate position;

a blocking section adjacent to and contiguous with one end of said main section and extending angularly therefrom for preventing said handle from moving from said intermediate position to the other end of said aperture;

a first holding tab for seating said attachment contiguous with said main section and being generally disposed at the other end of said main section said first tab extending angularly outward from said freeway defined by said main section; and a second holding tab for further seating said attachment, said second tab contiguous with said blocking section opposite said main section, said second tab extending angularly outward from said blocking section and away from said freeway defined by said main section said sections and said tabs defining a single element being constructed of relatively stiff sheet material which is resiliently deformable to permit relative inward movement between said tabs for mounting and dismounting in said seating formations.

9. A handle blocking means as recited in claim 8 wherein said angle is an obtuse angle.

10. A handle blocking attachment as recited in claim 8 in which the attachment is constructed of sheet steel.

11. A handle blocking attachment as recited in claim 8 further comprising lateral stabilizing means for engaging the outer surface of said front cover.

12. A handle blocking attachment as recited in claim 11 wherein said lateral stabilizing means includes formations extending outwardly from said blocking section away from said freeway for engaging the outer surface of said front cover.

13. A handle blocking attachment as recited in claim 8 further comprising a tool receiving means disposed in the vicinity of one of said tabs to receive a tool through which a force is applied to said attachment in a direction resulting in a relatively inward movement of said tabs.

14. A handle blocking attachment as recited in claim 13 wherein the tool receiving means includes a slot in the vicinity of said second holding tab.

15. A handle blocking attachment as recited in claim 8 in which said blocking section is provided with a window through which handle-position indicia carried by the handle is viewable from in front of said attachment.

16. A handle blocking attachment as recited in claim 8 in which said main section is provided with a window through which said contact operating handle is viewable from in front of said attachment.

17. A handle blocking attachment as recited in claim 8 in which said main section is provided with an aperture means to allow said contact operating handle to extend therethrough.

* * * * *

UNITED STATES PATENT AND TRADEMARK OFFICE

CERTIFICATE OF CORRECTION

PATENT NO. : 4,300,030

DATED : November 10, 1981

INVENTOR(S) : Bernard DiMarco and Andrew J. Kralik

It is certified that error appears in the above-identified patent and that said Letters Patent are hereby corrected as shown below:

In the Abstract, line 7, please change "inverter" to --inverted--; and

In Claim 8, line 42, please change "suface" to --surface--.

Signed and Sealed this

Ninth Day of February 1982

[SEAL]

Attest:

GERALD J. MOSSINGHOFF

Attesting Officer

Commissioner of Patents and Trademarks